US008876625B2

(12) United States Patent
Curtis et al.

(10) Patent No.: US 8,876,625 B2
(45) **Date of Patent: *Nov. 4, 2014**

(54) GOLF CLUB WITH IMPROVED PERFORMANCE CHARACTERISTICS

(71) Applicant: Acushnet Company, Fairhaven, MA (US)

(72) Inventors: Andrew J. Curtis, Carlsbad, CA (US); Noah de la Cruz, San Diego, CA (US); Charles E. Golden, Encinitas, CA (US); Bradford Hughes Hartwell, Encinitas, CA (US); Gregory D. Johnson, Carlsbad, CA (US); John W. Morin, Poway, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/938,498

(22) Filed: Jul. 10, 2013

(65) Prior Publication Data

US 2013/0303306 A1 Nov. 14, 2013

Related U.S. Application Data

(63) Continuation of application No. 12/490,635, filed on Jun. 24, 2009, now Pat. No. 8,496,544.

(51) Int. Cl.
*A63B 53/00* (2006.01)
*A63B 53/04* (2006.01)

(52) U.S. Cl.
CPC ..... *A63B 53/0466* (2013.01); *A63B 2053/0416* (2013.01); *A63B 2053/0408* (2013.01); *A63B 2053/0412* (2013.01); *A63B 2209/00* (2013.01)
USPC ..... 473/292; 473/345

(58) Field of Classification Search
USPC ..... 473/324–350, 292
See application file for complete search history.

(56) References Cited

U.S. PATENT DOCUMENTS 5,190,289 A * 3/1993 Nagai et al. ..... 473/327
5,839,975 A 11/1998 Lundberg (Continued)

FOREIGN PATENT DOCUMENTS

JP 11-319166 A 11/1999
JP 2000-210398 A 8/2000

(Continued)

OTHER PUBLICATIONS

Jackson, Jeff, The Modern Guide to Golf Clubmaking, Ohio, Dyanacraft Golf Products, Inc., copyright 1994, pp. 236-237.

*Primary Examiner* — Alvin Hunter
(74) *Attorney, Agent, or Firm* — Randy K. Chang

(57) ABSTRACT

A metal wood type golf club with improved performance characteristics is disclosed herein where the metal wood type golf club head will combined the performance characteristics of both a driver type golf club head and a fairway type golf club head. More specifically, the present invention relates to a golf club head with a volume of between about 150 cc to about 360 cc, a CG location between about 10 mm to about 20 mm above the ground, a face depth of between about 30 millimeters (mm) to about 65 millimeters (mm), a loft of about between 10 degrees to about 16 degrees, and a COR of about 0.790 to about 0.830, wherein the entire golf club has a length of between about 41 inches to about 45 inches.

13 Claims, 10 Drawing Sheets

(56) References Cited

U.S. PATENT DOCUMENTS

| | | | | |
|---|---|---|---|---|
| 5,935,020 | A | 8/1999 | Stites et al. | |
| 6,048,278 | A | 4/2000 | Meyer et al. | |
| 6,254,494 | B1 * | 7/2001 | Hasebe et al. | 473/349 |
| 6,299,549 | B1 | 10/2001 | Shieh | |
| 6,340,337 | B2 * | 1/2002 | Hasebe et al. | 473/349 |
| 6,354,962 | B1 | 3/2002 | Galloway et al. | |
| 6,425,832 | B2 | 7/2002 | Cackett et al. | |
| 6,454,664 | B1 | 9/2002 | Long et al. | |
| 6,491,592 | B2 | 12/2002 | Cackett et al. | |
| 6,530,847 | B1 | 3/2003 | Antonious | |
| 6,572,491 | B2 * | 6/2003 | Hasebe et al. | 473/349 |
| 6,669,577 | B1 * | 12/2003 | Hocknell et al. | 473/329 |
| 6,676,535 | B2 | 1/2004 | Sheets et al. | |
| 6,776,726 | B2 | 8/2004 | Sano | |
| 6,860,824 | B2 | 3/2005 | Evans | |
| 6,875,129 | B2 | 4/2005 | Erickson et al. | |
| 7,137,905 | B2 | 11/2006 | Kohno | |
| 7,147,572 | B2 | 12/2006 | Kohno | |
| 7,354,353 | B2 | 4/2008 | Hocknell et al. | |
| 8,496,544 | B2 * | 7/2013 | Curtis et al. | 473/345 |
| 8,591,353 | B1 * | 11/2013 | Honea et al. | 473/345 |
| 2002/0193175 | A1 | 12/2002 | Soracco et al. | |
| 2008/0161124 | A1 | 7/2008 | Kajita | |
| 2009/0170632 | A1 | 7/2009 | Beach et al. | |

FOREIGN PATENT DOCUMENTS

| | | | |
|---|---|---|---|
| JP | 2002-239041 | A | 8/2002 |
| JP | 2003-111874 | A | 4/2003 |
| JP | 2011-253586 | A | 12/2011 |

* cited by examiner

GOLF CLUB WITH IMPROVED PERFORMANCE CHARACTERISTICS

CROSS-REFERENCE TO RELATED APPLICATIONS

This application is a Continuation of co-pending U.S. patent application Ser. No. 12/490,635, filed on Jun. 24, 2009, the disclosure of which is incorporated by reference in its entirety.

FIELD OF THE INVENTION

The present invention relates generally to a golf club with improved performance characteristics. More specifically, the present invention relates to a metal wood type golf club that is capable of achieving extreme distances similar to that of a driver type golf club head while having the controllability and accuracy of a fairway type golf club head. Even more specifically, the present invention relates to a metal wood type golf club wherein the club head has a height of center of gravity (CG) to face depth ratio of less than about 0.4, a volume of about 150 cubic centimeters (cc) to about 360 cubic centimeters (cc), a face depth of between about 30 millimeters (mm) to about 65 millimeters (mm), a coefficient of restitution (COR) of greater than about 0.790, and a CG location of about 10 mm to about 20 mm off the ground.

BACKGROUND OF THE INVENTION

The complexities of golf club design are well known. The specifications for each component of a club (i.e. the club head, shaft, hosel, grip, and subcomponents thereof) directly impact the performance of the golf club. Thus, by varying the design specifications, a golf club can be tailored to have specific performance characteristics.

Players utilizing metal wood type golf clubs have generally desired a golf ball trajectory that is longer and straighter, especially when compared to their iron type golf clubs. However, when a metal wood type golf club head is designed to maximize distance, it can sometimes do so at the expense of sacrificing accuracy. Hence, finding the correct balance of length and accuracy in a metal wood type golf club may be difficult, as numerous factors affect the length and accuracy of a metal wood type golf club.

Generally, a specific type of metal wood type golf club head called a "driver" has been used to maximize distances of a golf shot. Driver type golf club heads may achieve maximum distance by utilizing a variety of factors such as a longer shaft, a face having a higher coefficient of restitution (COR), a larger volume that is generally greater than 400 cc, a lighter material such as titanium, and a deeper face depth; resulting in a higher CG location due in part to its physical shape. Driver type golf club heads, because of their higher CG location combined with a deeper face depth, generally perform better off a tee. The focus on performance off a tee for the driver type golf club generally makes it more difficult for the driver type golf club head to hit a golf ball sitting on the ground without a tee; as the higher CG location of a driver type golf club head makes the sweet spot higher off the ground. Moreover, driver type golf club heads, although capable of maximizing the distance of travel of a golf ball upon impact, may generally suffer in terms of accuracy due to the increased shaft length as well as the increased face volume.

FIG. 1 shows a front view of a driver type golf club head 100 in accordance with a prior art metal wood type golf club head. Driver type golf club head 100, as shown in FIG. 1, illustrates the driver type golf club head 100 having a face 102, a hosel 104, and a shaft 106; wherein the driver type golf club head 100 has a CG 108 location that is at a distance d1 from the ground level 110. Face 102 in this prior art driver type golf club head 100 may have a plurality of scorelines 112 around the perimeter of the face 102. Scorelines 112 may generally be undesirable near the central impact portion of the face 102 as scorelines 112 decrease the overall thickness of the face 102, which in turn affects durability of the face 102. Face 102 in this prior art driver type golf club head may generally have a total face depth height of d11 measured from the ground level 110; wherein d11 may generally be greater than 55 mm from the ground level 110. This depth of face 102 of the prior art driver type golf club head 100 may generally be defined as the location of the earliest departure from the planer face 102 and it helps define the general profile and geometry of the prior art driver type golf club head 100 to yield a CG height to face depth ratio of greater than about 0.4.

It should also be noted that in this prior art driver type golf club head 100, the CG 108 location is relatively high off the ground level 110. This height distance d1 of CG 108 may generally be greater than about 20 mm off the ground 110, due to the large geometric shape of a driver type golf club head 100. A driver type golf club head 100 may generally have a club length of greater than about 44 inches, as the increased club length generally generates more distance through increased momentum. However, it is generally known in the art that increasing shaft length may generally have an adverse affect in decreasing the overall club accuracy for the golfer. Finally a golf ball 150 is shown in FIG. 1 to provide a reference of dimension of driver type golf club head 100 and CG 108 height d1 relative to a golf ball 150.

Turning now to FIG. 2, which shows a cross sectional side view of a prior art driver type golf club head 200 positioned behind a golf ball 250 wherein the CG 208 location of the prior art driver type golf club head 200 is at a distance d1 from the ground 210. The CG location 208 in a driver type golf club head 200, as shown in FIG. 2 may generally be higher than the height of the equator of the golf ball 250, making this driver type golf club head 200 difficult to hit a golf ball 250 that rests on the ground 210. In addition to the above, FIG. 2 may also show the face 202 of the prior art driver type golf club head 200 forming a loft angle $\alpha$ with a plane that is perpendicular to the ground 210. Loft angle $\alpha$ of this prior art driver type golf club head 200 may generally be between about 7.0 degrees to about 13.0 degrees resembling the low loft angles $\alpha$ that are typical for a driver type golf club head 200. This low loft angle $\alpha$ creates a low launching golf shot that is capable of maximizing the distance for a driver type golf club head 200. Finally, FIG. 2 shows a rounded leading edge 240 that is floating off the ground 210 generally found in a driver type golf club heads 200. This rounded leading edge 240 in a driver type golf club head 200 helps reduce weight at unnecessary locations that could be maximized elsewhere. Because driver type golf club heads 200 are generally only used to hit a golf ball off a tee, the leading edge 240 area may be shaved or removed without adversely effecting performance. However, if a driver type golf club head 200 is used to hit a golf ball 250 off the ground, this rounded leading edge may adversely affect the ability of a driver type golf club head 200 to interact with the turf making it difficult to hit a golf ball 250 of the ground 210.

Despite all the attempts to maximize distance of a golf shot, accuracy of a golf shot may be just as important; as golf balls that land in the rough areas of a golf course are more difficult to hit than those that land in the fairway areas of a golf course.

Taller grass tends to push the club head off its intended path, and as blades of grass fall between the ball and the striking face, the added lubrication of the blades of grass decreases the friction and reduces the outgoing backspin of the golf ball. In order to address this differentiation in shot difficulty, many iron type golf club heads, especially wedge type golf club heads, have added aggressive groove configurations that help mitigate the loss in spin between a golf ball hit out of the rough when compared to a golf ball hit off of the fairway. Also, iron and wedge designs feature special sole widths and sole curvatures to help the golf club slide through the turf and keep the club head traveling along its intended path. However, despite all the advancements in iron type golf club heads to make shots out of the rough perform as well as shots hit out of the fairway, there still exists a dramatic difference in the shot difficulty; making accuracy of golf shots off the tee box an extremely desirable characteristic.

In order to address the decreased accuracy issue in driver type golf club head, some golfers use fairway type golf club heads to increase accuracy of their tee shots at the expense of sacrificing some distance when compared to a driver type golf club head. Fairway type golf club heads may generally achieve more accuracy than a driver type golf club head due in part to its shorter shaft, smaller volume of generally less than 400 cc, steel material, shallower face depth, and lower CG derived from its physical shape as well as higher lofts. Fairway type golf club heads, because of their lower CG location, shallower face depth, sharper leading edge, and forgiving sole curvatures, are generally capable of performing well when hitting a golf ball off the ground especially compared to a driver type golf club head. Despite their accuracy, fairway type golf club heads generally sacrifice significant distance when compared to driver type metal wood golf clubs due to their inherent properties such as being made out of a steel type material, having a lower COR, as well as having a shorter shaft.

FIG. 3 shows a prior art fairway type golf club head 300 having a CG location 308 that is at a distance d3 from ground 310. Fairway type golf club head 300 may generally have a CG location height distance d3 of less than about 17 mm. This distance d3 of a fairway type golf club head 300 is significantly lower than the height distance d1 depicting the CG location 108 of a driver type golf club head 100. (shown in FIG. 1) A fairway type golf club head 300 generally differs from a driver type golf club head 100 in that it has a shallower profile as shown in FIG. 3 with a total face depth d33 that is significantly lower than distance d11 shown in FIG. 1. Face depth height d33 may generally be greater than about 35 mm from the ground level 310. The shallower head profile of fairway type golf club head 300, combined with a smaller volume, shorter shaft, and the steel type material construction allows CG location 308 to be located below the golf ball 350, making it easier for fairway type golf club head 300 to perform when hitting a golf ball 350 off the ground 310. Ultimately, this face depth d33 and the CG height d3 may help define a CG height over face depth ratio of greater than about 0.4 as well.

Fairway type golf club head 300 may generally have a plurality of score lines 312 across the entire face 302, as durability of the face 302 of the fairway type golf club head 300 is generally less of a concern due to its steel construction. Although not shown in FIG. 3, fairway type golf club head 300 may generally have a higher loft angle of greater than about 13 degrees in order to create a higher trajectory for a golf ball 350 hit using a fairway type golf club head 300. A fairway type golf club head 300 may generally have a club length of about 42 inches to about 44 inches; as the shorter club length allows for more control. Finally, golf ball 350, as shown in FIG. 3, provides a reference of dimension of fairway type golf club head 300 and CG 308 height d3 relative to a golf ball 350.

It can be seen that both a driver type golf club head and a fairway wood type golf club head have their own separate and distinct advantages when compared to one another. However, both the driver type golf club head and a fairway wood type golf club have significant disadvantages associated with their inherent design, making the advantages of each almost mutually exclusive from one another. Hence it can be seen, there is tremendous advantage in the field for a metal wood type golf club head that can maintain the distance advantages of a driver type golf club head while having the accuracy and stability of a fairway type golf club head while also being capable of hitting a golf ball directly off the ground. More specifically, there is a need in the field for a metal wood type golf club head that has an increased performance characteristic that incorporates both the advantages of a driver type golf club head and a fairway type golf club head.

BRIEF SUMMARY OF THE INVENTION

In one aspect of the present invention is a metal wood type golf club head comprising of a face portion and a body portion. The face portion of the head has a striking surface that has a measurable total face depth used for striking a golf ball. The body portion extends from the rear section of the face portion and has a crown portion and a sole portion. The metal wood type golf club head may have a volume of about 150 cc to about 360 cc as well as a CG location that is positioned at a measurable distance above the ground level; wherein the head has a CG to face depth ratio of less than about 0.40. The CG to face depth ratio is defined by the height of the CG location over the total face depth.

In another aspect of the present invention is a metal wood type golf club comprising of a shaft, a grip connected to a proximal end of the shaft, and a head connected to a distal end of the shaft. The head itself is further comprised of a face portion and a body portion. The face portion of the head has a striking surface that has a measurable total face depth used for striking a golf ball as well as a body portion. The body portion extends from the rear section of the face portion and has a crown portion and a sole portion. The head of the metal wood type golf club may have a volume of about 150 cc to about 360 cc as well as a CG location that is positioned at a measurable distance above the ground level; wherein the head has a performance factor of greater than about 2,900 g-cm$^2$. This Performance Factor, as referred to above, may generally be defined as the product of the face depth, A COR value of the head, and a MOI value of the head about a y-axis all divided by the height of the CG location.

In a further aspect of the present invention is a metal wood type golf club comprising of a shaft, a grip connected to a proximal end of the shaft, and a head connected to a distal end of the shaft. The head itself is further comprised of a face portion and a body portion. The face portion of the head has a striking surface that has a measurable total face depth used for striking a golf ball. The body portion extends from the rear section of the face portion and has a crown portion and a sole portion. The head of the metal wood type golf club may have a volume of about 150 cc to about 360 cc as well as a CG location that is positioned at a measurable distance above the ground level. The face portion of the metal wood type golf club in accordance with this further aspect of the present invention may be further comprised of a top portion containing a first radius of curvature and a bottom portion containing a second radius of curvature, wherein the second radius of curvature is greater than the first radius of curvature.

In an even further aspect of the present invention is a metal wood type golf club comprising of a shaft, a grip connected to a proximal end of the shaft, and a head connected to a distal end of the shaft. The head itself is further comprised of a face portion and a body portion. The face portion of the head has a striking surface that has a measurable total face depth used for striking a golf ball as well as a body portion. The body portion extends from the rear section of the face portion and has a crown portion and a sole portion. The head of the metal wood type golf club may have a volume of about 150 cc to about 360 cc as well as a CG location that is positioned at a measurable distance above the ground level; wherein the head has an accuracy factor of less than about 550 g-cm$^2$. This Accuracy Factor, as referred to above, may generally be defined as the product of a MOI value of the head about a shaft axis multiplied by the height of the CG location all divided by the product of the face depth and the COR value.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

"Metal wood type golf club head", as described in the current invention may generally relate to a hollowed body golf club that could be made out of various materials that may not be metal without departing from the scope and content of the present invention.

Figure 4:
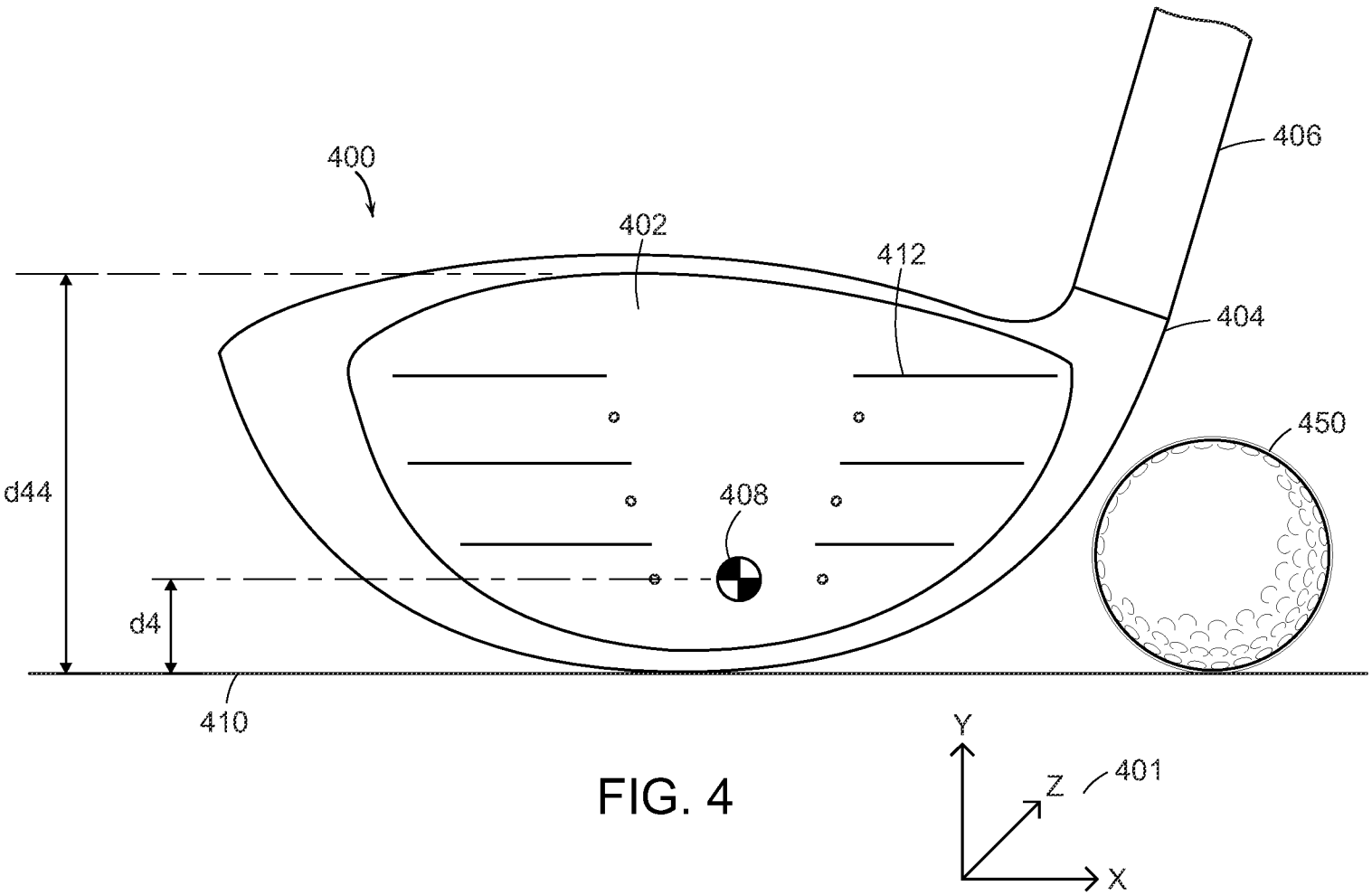
FIG. 4 shows a front view of an inventive metal wood type golf club head in accordance with an exemplary embodiment of the present invention.

FIG. 4 shows a frontal view of an inventive metal wood type golf club head 400 in accordance with an embodiment of the present invention. Inventive metal wood type golf club head 400 may contain a face portion 402 having a total face depth height of d44 from the ground 410, a hosel 404, a shaft 406, and a CG location 408 that is at a distance d4 from the ground 410. First and foremost, inventive metal wood type golf club head 400, as shown in the current exemplary embodiment, may generally be comprised of a titanium based material in order to reduce overall weight of the metal wood type golf club head 400 and to create discretionary weight in helping optimize the CG 408 location of the metal wood type golf club head 400. However, various other materials such as aluminum, carbon fiber composite, or any other material that has a relatively low density may partially supplement or completely replace the titanium material without departing from the scope and content of the present invention. For reference purposes, FIG. 4 also shows a golf ball 450 providing a reference of dimension of the inventive metal wood type golf club head 400 as well as the CG 408 height d4 compared to a golf ball 450. Furthermore, FIG. 4 also shows a reference coordinate system 401 wherein the x-axis is horizontal to the face, the y-axis is vertical through the club, and the z-axis goes in and out of the page through the front and back of the club.

Inventive metal wood type golf club head 400 may generally be comprised of a face portion 402 combined with a body portion extending from the rear of the face portion 402. This body portion may be further comprised of a crown portion and a sole portion as shown in FIG. 4.

Figure 1:
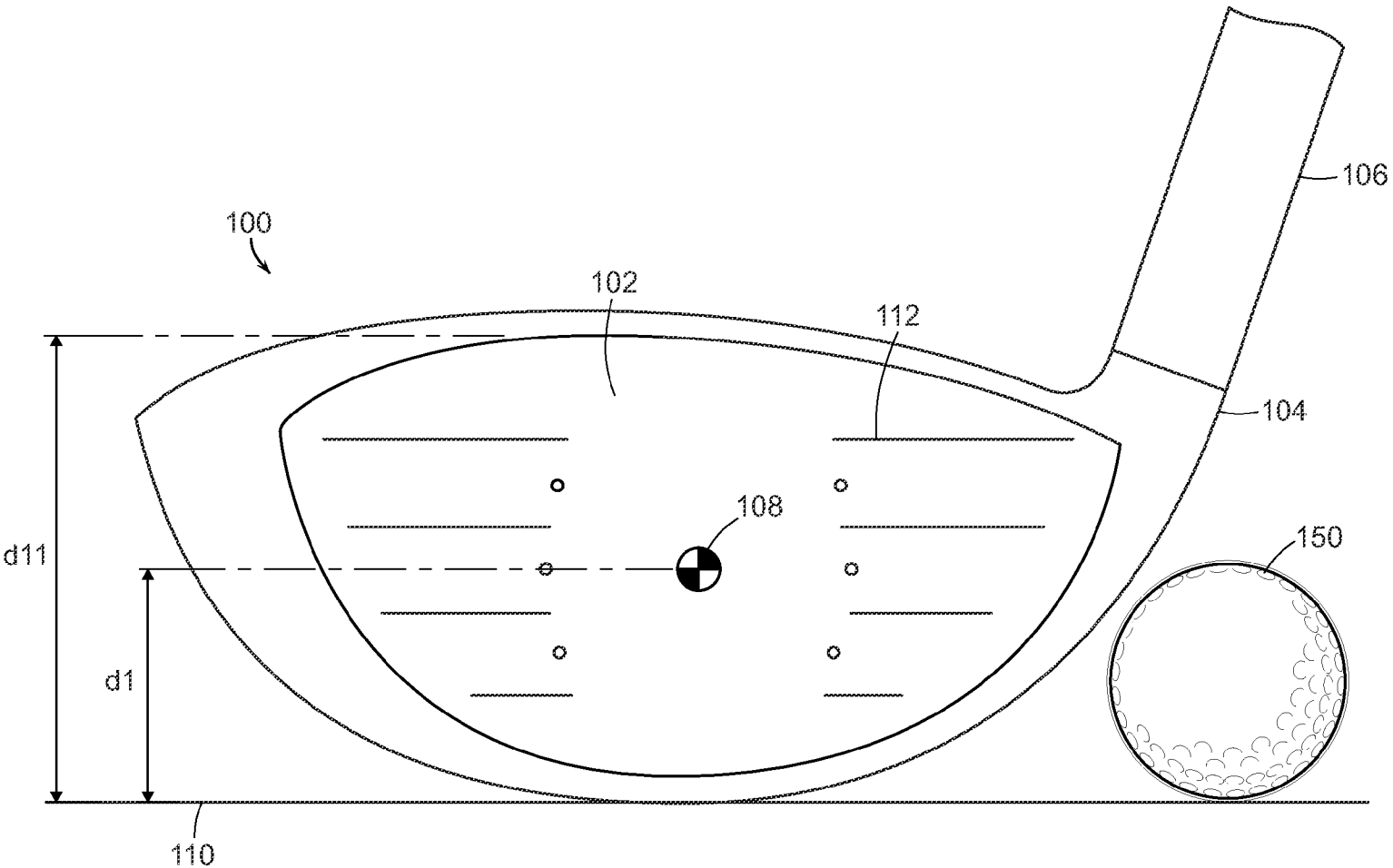
FIG. 1 Prior Art
FIG. 1 shows a front view of a driver type golf club head in accordance with a prior art golf club head.
Figure 2:
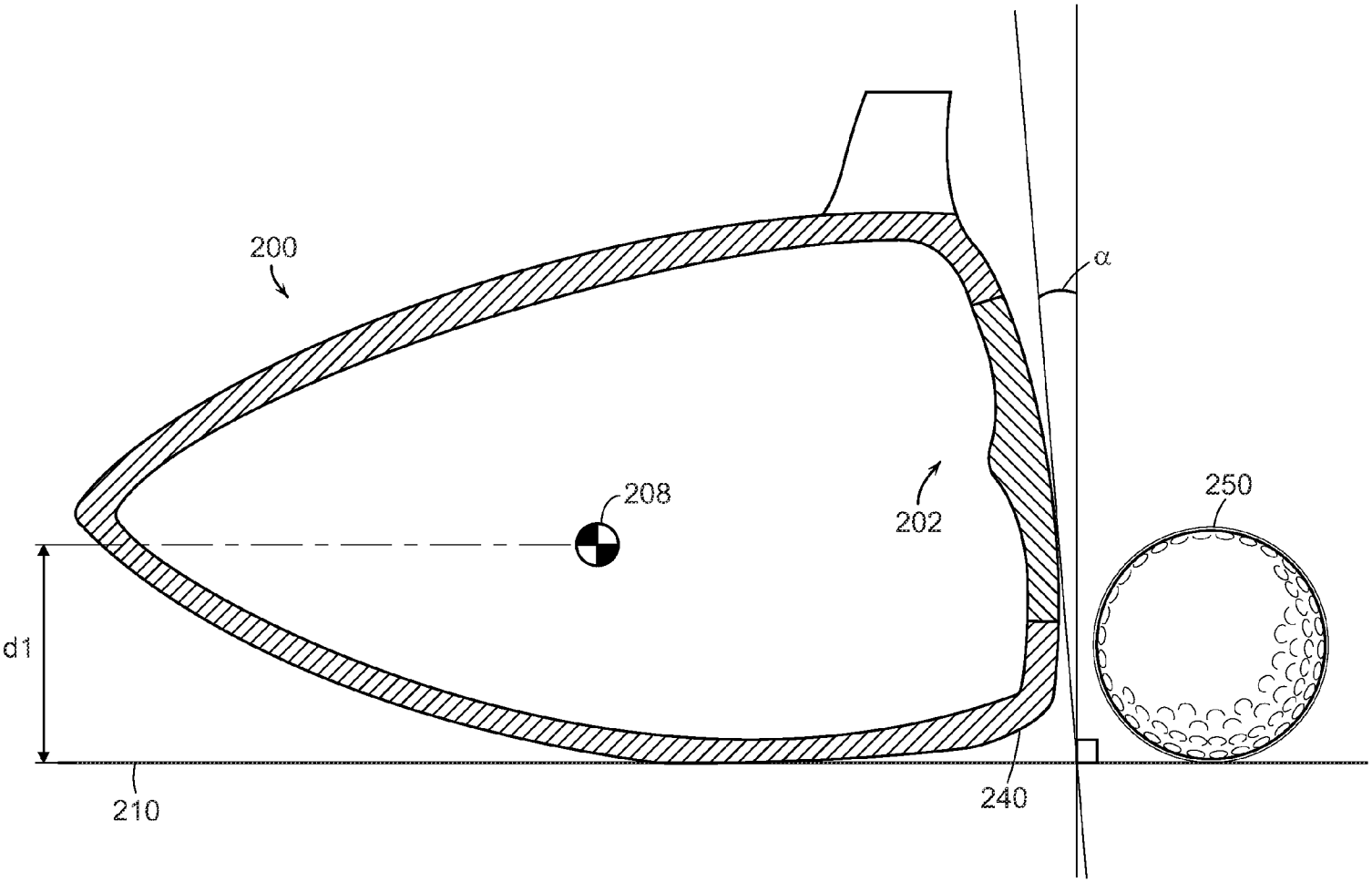
FIG. 2 Prior Art
FIG. 2 shows a cross-sectional view of a driver type golf club head in accordance with a prior art golf club head.

FIG. 4 also shows the relative dimension of the inventive metal wood type golf club head 400 next to the golf ball 450 gives a perspective of the size of the inventive metal wood type golf club head 400 relative to a driver type golf club head 100 (shown in FIG. 1) and a fairway type golf club head 300. (Shown in FIG. 3) In the current exemplary embodiment, the inventive metal wood type golf club head 400 may generally have a volume that is greater than a fairway type golf club head 300 but smaller than a driver type golf club head 100, with an actual volume of about 150 cc to about 360 cc, more preferably between about 170 cc to about 340 cc, and most preferably between about 200 to about 300 cc. This volume range may generally yield an inventive metal wood type golf club head 400 having a face 402 that has a face depth measuring d44 from the ground 410.

Inventive metal wood type golf club head 400, as shown in the current exemplary embodiment, may generally have a total mass of about 195 grams to about 220 grams. The weight of the inventive metal wood type golf club head 400 may generally be due partially to the smaller volume of the inventive metal wood type golf club head 400 as well as the light weight material that is used. The weight of the inventive metal wood type golf club head 400 may generally be between the total weight of a fairway type golf club head 300 and a driver type golf club head 100, allowing it to take advantage of the enhanced performance capabilities of both the driver type golf club head 100 as well as the fairway type golf club head 300.

Figure 3:
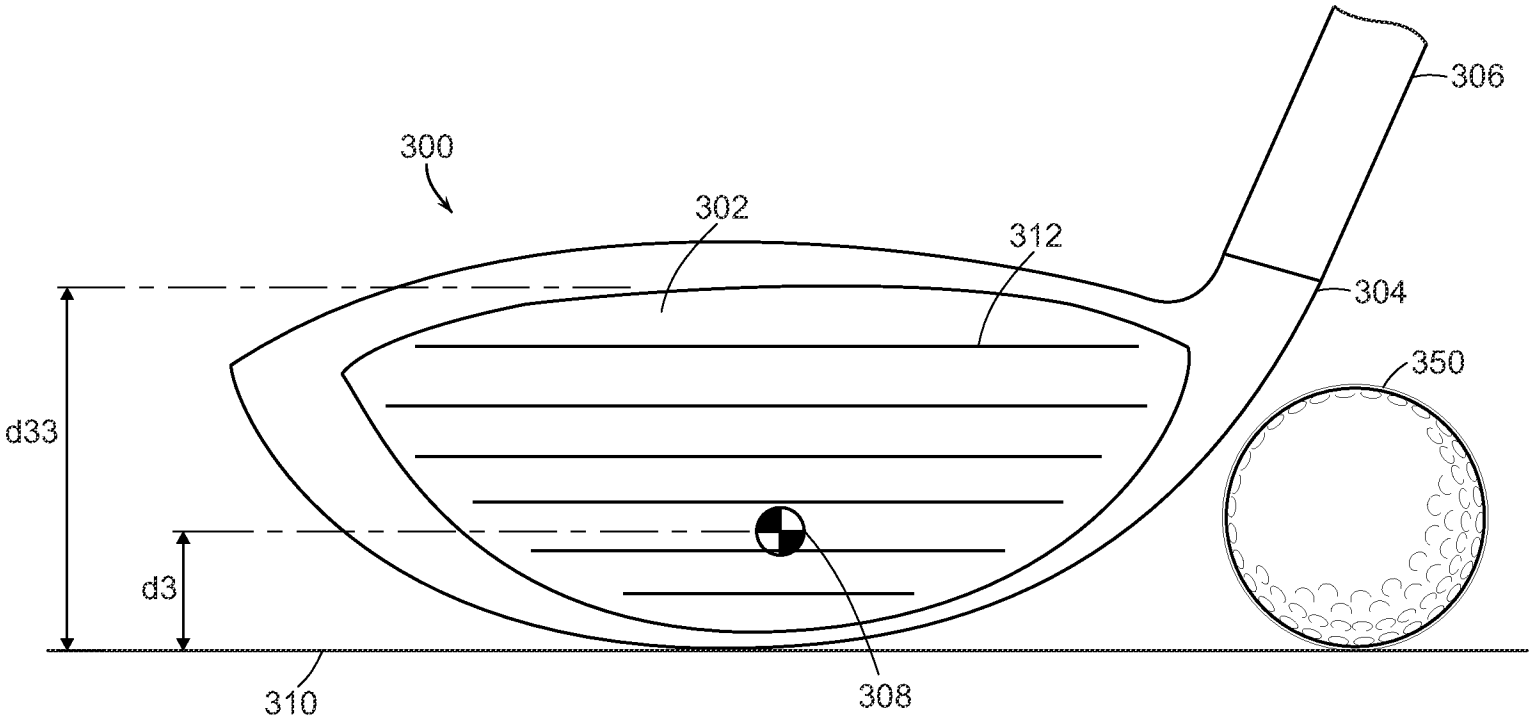
FIG. 3 Prior Art
FIG. 3 shows a front view of a fairway type golf club head in accordance with a prior art golf club head.

Face 402 of the inventive metal wood type golf club head 400 may generally be shallower than that of a driver type golf club head 100 (shown in FIG. 1), but deeper than that of a fairway type golf club head 300 (shown in FIG. 3). This means the inventive metal wood type golf club head 400, may have a face depth distance d44 less than the face depth distance d11 of a driver type golf club head 100, but greater than the face depth distance d33 of a fairway type golf club head 300. Similar to above, the depth of face 402 of current inventive metal wood type golf club head 400 may generally be defined as the location of the earliest departure from the planer face 402. This distance d44, as shown in the current exemplary embodiment, may generally be from about 30 mm to about 65 mm; as such a range of face depth may generally yield a larger striking area on the face 402 for greater performance characteristics. This extended face depth distance d44 creating a deeper face allows for a large striking area on the face 403 makes the inventive metal wood type golf club head 400 easier to hit.

However, it should be noted that too much of an extended face depth d44 makes such an inventive metal woods type golf club 400 more difficult to hit off the ground 410. In order to capture the capability of such an inventive metal woods type golf club 400 to hit a golf ball 450 off the ground, a "Depth to Volume Ratio" may be used FIG. 4, showing the relative size of the inventive metal wood type golf club head 400 in comparison to the golf ball 450 and the relative face depth distance d44 may generally yield a "Depth to Volume Ratio" of between about 0.08 mm/cc to about 0.50 mm/cc. This "Depth to Volume Ratio" may generally be defined as the total face depth distance d44 divided by the volume of the metal wood type golf club head 400 as defined by Equation 1 below.

$$\text{Depth to Volume Ratio} = \frac{\text{Face Depth Distance}}{\text{Total Volume}} \qquad \text{(Eq. 1)}$$

"Depth to Volume Ratio", as described above in Equation 1 may generally signify the ability of an inventive metal wood type golf club head 400 to hit a golf ball 450 off the ground 410. This is because a face depth d44 that is too tall may generally make the inventive metal wood type golf club head 400 harder to hit a golf ball 450 sitting on the ground 410. Conversely, an inventive metal wood type golf club head 400 that has a volume that is too large may also face the same disastrous fate when trying to hit a golf ball 450 off the ground 410.

Face 402, as shown in the current exemplary embodiment, based on the fact that it may be made out of titanium, may have a variable face thickness profile that increases the COR of the inventive metal wood type golf club head 400 without sacrificing durability of the face 402. Face 402 of the current invention, due partially to the increased surface area combined with the different material composition, may generally be able to achieve a COR value of between about 0.790 to about 0.830. This COR value of between about 0.790 to about 0.830 may generally resemble the COR values of a driver type golf club head 100 allowing the current inventive metal wood type golf club head 400 to achieve distance gains that are closer to that of a driver type golf club head 100.

It is worth noting that the inventive metal wood type golf club head 400 may generally have a CG location 408 that is significantly closer to the ground 410 at a distance d4 allowing for better performance capabilities when the inventive metal wood type golf club head 400 is used to strike a golf ball 450 directly off the ground 410. Distance d4, as shown in the current exemplary embodiment, may generally be between about 10 mm to about 20 mm off the ground 410, as such a lowered CG location 408 makes the club perform better off the ground 410. The current distance d4 may generally be significantly lower than the CG location 108 of a driver type golf club head 100 depicted as d1 in FIG. 1. It should also be noted that the current distance d4 may more closely resemble the CG location 308 of a fairway type golf club head 300 depicted as d3 in FIG. 3. The lowered CG location 408 of the current inventive metal wood type golf club head 400 may generally be significantly lower than the height of a golf ball 450, allowing the current inventive metal wood type golf club head 400 to have sufficient capability for hitting a golf ball 450 off the ground 410.

In view of the CG location 408 above represented by distance d4 as well as the total face depth d44 of the face 402, a CG to face depth ratio may be calculated by dividing d4 by d44. This CG to face depth ratio, as shown in the current exemplary embodiment, may generally be less than about 0.4, more preferably less than about 0.35, and most preferably less than about 0.3. The CG to face depth ratio is indicative of the ability of the inventive metal wood type golf club head 400 to perform off the ground while maintaining sufficient distance that was originally only capable in a driver type golf club head 100.

Inventive metal wood type golf club head 400, as shown in the current exemplary embodiment, may generally have a moment of inertia (MOI) of between about 2,500 g-cm$^2$ to about 4,500 g-cm$^2$ about the x-axis, the y-axis, and the z-axis. The MOI ranges of the current inventive metal wood type golf club head 400 may generally be attributed to the increased volume of the inventive metal wood type golf club head 400, especially when compared to a fairway wood type golf club head 300. In addition to the increased volume of the inventive metal wood type golf club head 400, various other features such as titanium material composition, composite material composition, and/or the geometric shape of the inventive metal wood type golf club head 400 may all help achieve the MOI ranges of between about 2,500 g-cm$^2$ to about 4,500 g-cm$^2$ along all of the axis of rotations of the golf club head 400. The MOI numbers of golf club head 400 about the y-axis is of particular interest in golf club head 400 as that number denotes the ability of a golf club head to resist twisting upon impact with a golf ball, creating straighter shots even when the golf ball 450 is struck off center. Because of the aforementioned reasons, the current inventive metal wood type golf club head 400 may be capable of taking advantage of the increased MOI values similar to the MOI numbers that were originally only capable in a driver type golf club head 100.

In view of the CG location 408 above, the total face depth d44, as well as the increased MOI numbers about the y-axis for the inventive metal wood type golf club head 400, a desirable "Performance Factor" can be derived. This desirable "Performance Factor" of the current inventive metal wood type golf club head 400 may generally be defined as the face depth d44 of the face 402 of the CG location 408 multiplied by the MOI number (about the y-axis of rotation) and then multiplied by the COR of the metal wood type golf club head 400 all divided by the height d4 of the CG location 408 as shown below in Equation 2.

$$\text{Performance Factor} = \frac{\text{Depth of Face} * MOI(y\text{-axis}) * COR}{\text{Height of } CG \text{ Location}} \quad \text{(Eq. 2)}$$

The inventive metal wood type golf club head 400, in accordance with an exemplary embodiment of the present invention, may generally have a "Performance Factor" of greater than about 2,900 g-cm$^2$. More specifically, the inventive metal wood type golf club head 400 may have a "Performance Factor" of between about 2,900 g-cm$^2$ and about 22,410 g-cm$^2$. This "Performance Factor" is indicative of the ability of an inventive metal wood type golf club head 400 to perform well hitting a golf ball 450 off the ground as well as the ability of the inventive metal wood type golf club head 400 off a tee, while maintaining a higher COR to result in a metal wood type golf club head 400 having increased distance.

In addition to the MOI numbers about the y-axis mentioned above, it is also worth nothing that the MOI of the inventive metal wood type golf club head 400 about the shaft axis may also be of concern. Shaft axis may be more easily understood as an axis of rotation about the shaft 406 of the inventive metal wood type golf club head 400. The MOI of an inventive metal wood type golf club head 400 about the shaft axis represents the ability of the golf club head 400 to resist twisting about the shaft as it impacts a golf ball. The current inventive metal wood type golf club head 400 may generally have a MOI about the shaft axis of between about 3,000 g-cm$^2$ to about 6,000 g-cm$^2$. MOI range about the shaft axis of the current inventive metal wood type golf club head 400 may generally resemble that of a fairway type golf club head 300 due to the decreased volume of the current inventive metal wood type golf club head 400, allowing the inventive metal wood type golf club head 400 to be more accurate.

The MOI number about the shaft axis for the inventive metal wood type golf club head 400 may be combined with the various other factors such as depth d44 of face 402, COR of the inventive metal wood type golf club head 400 as well as the height d4 of the CG location 408 to yield an "Accuracy Factor." This "Accuracy Factor" of the current inventive metal wood type golf club head 400 may generally be defined as by the MOI about the shaft axis multiplied by the height d4 of the CG location 408 divided by the product of the face depth d44 of the face 402 and the COR of the metal wood type golf club head 400 as shown below in Equation 3.

$$\text{Accuracy Factor} = \frac{MOI(\text{shaft-axis}) * \text{Height of } CG \text{ Location}}{\text{Depth of Face} * COR} \quad \text{(Eq. 3)}$$

The inventive metal wood type golf club head 400, in accordance with an exemplary embodiment of the present invention, may generally have an "Accuracy Factor" of less than about 550 g-cm$^2$. More specifically, the inventive metal wood type golf club head 400 may have an "Accuracy Factor" of between about 55 g-cm$^2$ and about 550 g-cm$^2$. This "Accuracy Factor" is indicative of the ability of an inventive metal wood type golf club head 400 to resist twisting for off-center hits, resulting in a metal wood type golf club head 400 having increased accuracy.

Finally, the frontal view of an inventive metal wood type golf club head 400 shown in FIG. 4 also illustrates a plurality of score lines 412 on the face portion 402 of the inventive metal wood type golf club head 400. As it can be seem in FIG. 4, inventive metal wood type golf club head 400 may have a score line 412 pattern similar to that of a driver type golf club head 100 seen in FIG. 1. This score line 412 pattern does not cross the central portion of the face portion 402 due to durability issues of the thinned titanium material generally used for the striking surface of driver type golf club heads 100. The lack of score lines 412 at the central impact portion creates a more uniform thickness distribution at the impact portion, eliminating weak points in the face portion 402 at the points of impact.

Figure 5:
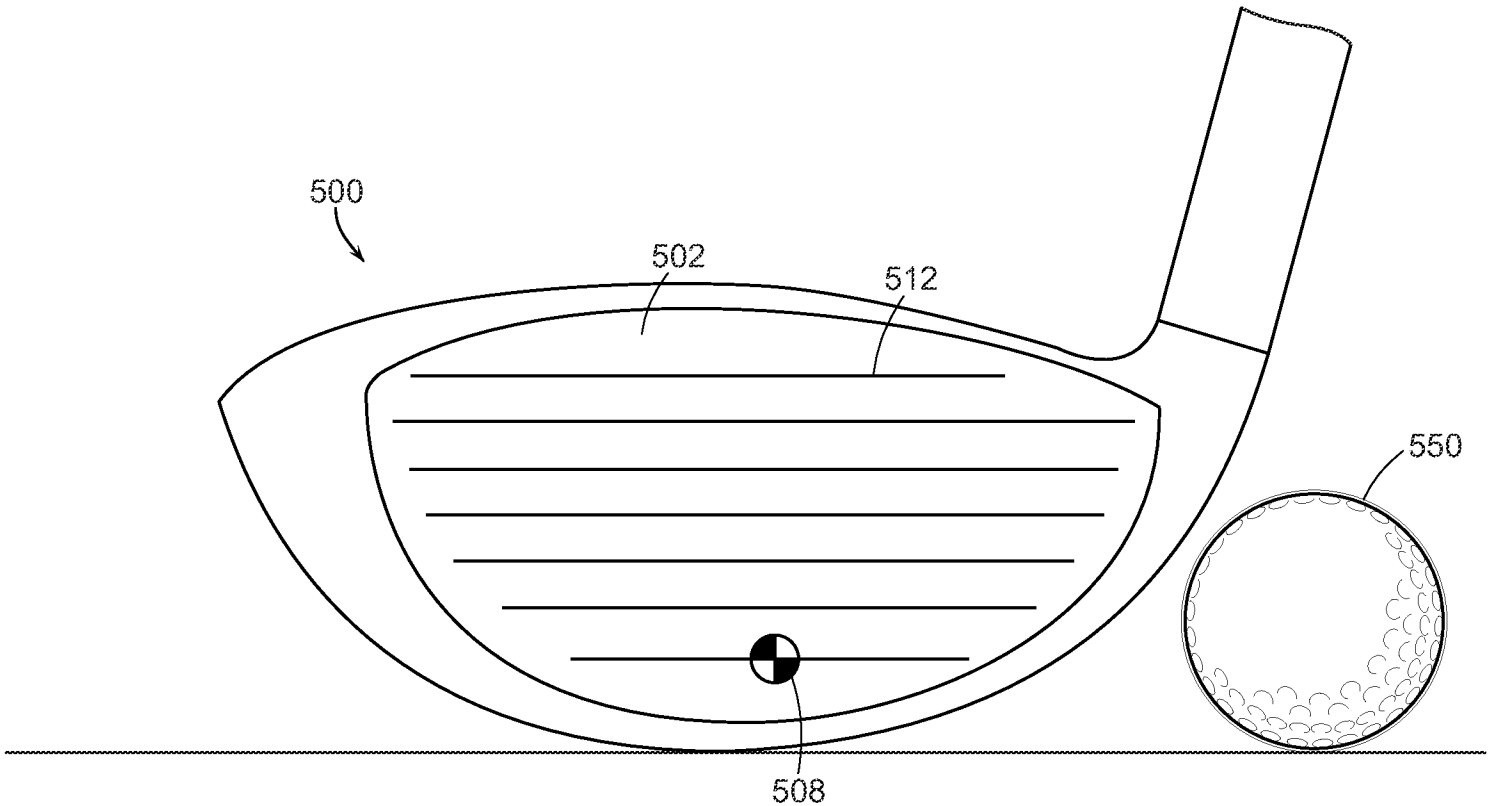
FIG. 5 shows a front view of an inventive metal wood type golf club head in accordance with an alternative embodiment of the present invention.

Despite the score line patterns disclosed in FIG. 4 for the purposes of preserving durability of the inventive metal wood type golf club head 400, FIG. 5 shows an alternative embodiment of the present invention wherein the inventive metal wood type golf club head 500 may have a face portion 502 that has a constant uniform plurality of score lines 512 horizontally across the entire face portion 502. Because of the reduced volume of the current inventive metal wood type golf club head 500, combined with the reduction in face portion 502 depth, inventive metal wood type golf club head 500 may generally have a more compact face portion 502 when compared to a driver type golf club head 100, reducing the durability concerns generally associated with a metal wood type golf club head 500 having a large face portion 502. Without limited concern for durability, the inventive metal wood type golf club head 500 may have a plurality of score lines 512 that run across the entire surface of the face portion 502 resembling the score lines 312 of a fairway type golf club head 300, inspiring more confidence when using the current inventive metal wood type golf club head 500 off the ground 510.

Figure 6:
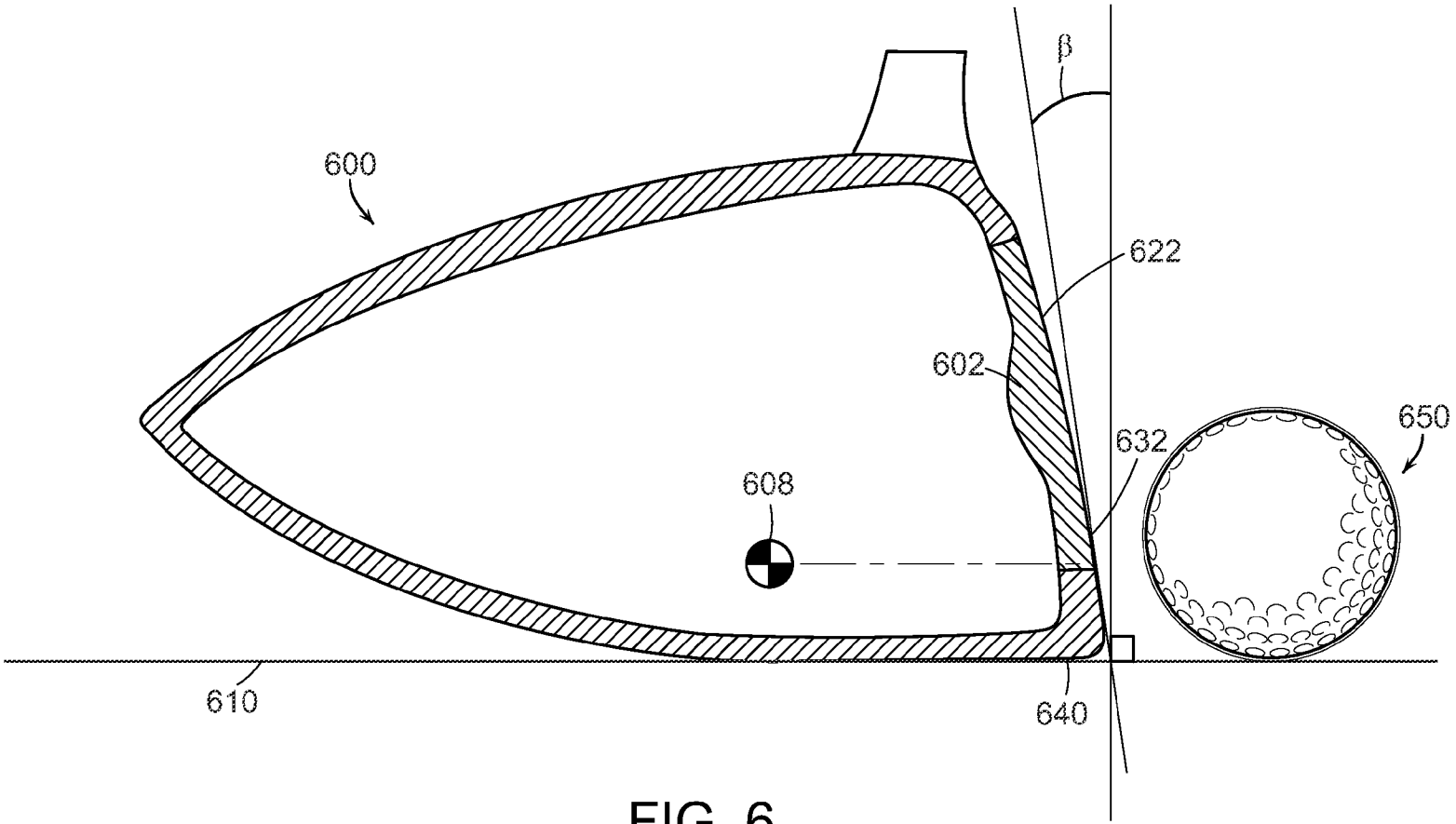
FIG. 6 shows a cross-sectional view of an inventive metal wood type golf club head in accordance with an exemplary embodiment of the present invention.

FIG. 6 shows a cross sectional view of the inventive metal wood type golf club head 600 in accordance with an embodiment of the present invention having a variable face thickness of the face portion 602. The current cross-sectional view of the inventive metal wood type golf club head 600 also shows the relative position of the CG location 608 within the golf club head. Finally, FIG. 6 also shows the inventive metal wood type golf club head 600 having a loft angle β measured between the face portion 602 and a vertical plane relative to ground 610. Inventive metal wood type golf club head 600, in order to create the perfect balance of distance and accuracy, will generally have a loft angle β of between about 10 degrees to about 16 degrees, more preferably between about 11 degrees and about 14 degrees, and most preferably about 12 degrees all without departing from the scope and content of the present invention.

The side cross-sectional view of the inventive metal wood type golf club head 600 shown in FIG. 6 is also capable of showing the variable face thickness profile of the face portion 602. In addition to the variable face thickness profile of the back of the face portion 602 of the inventive metal wood type golf club head, the inventive metal wood type golf club head 600 may have a dual portioned face portion 602 creating a top portion 622 and a bottom portion 632 at the frontal portion of the face portion 602. The dual portioned face portion 602 creates two different face roll profiles to compensate for different shots of the inventive metal wood type golf club head 600.

Figure 7:
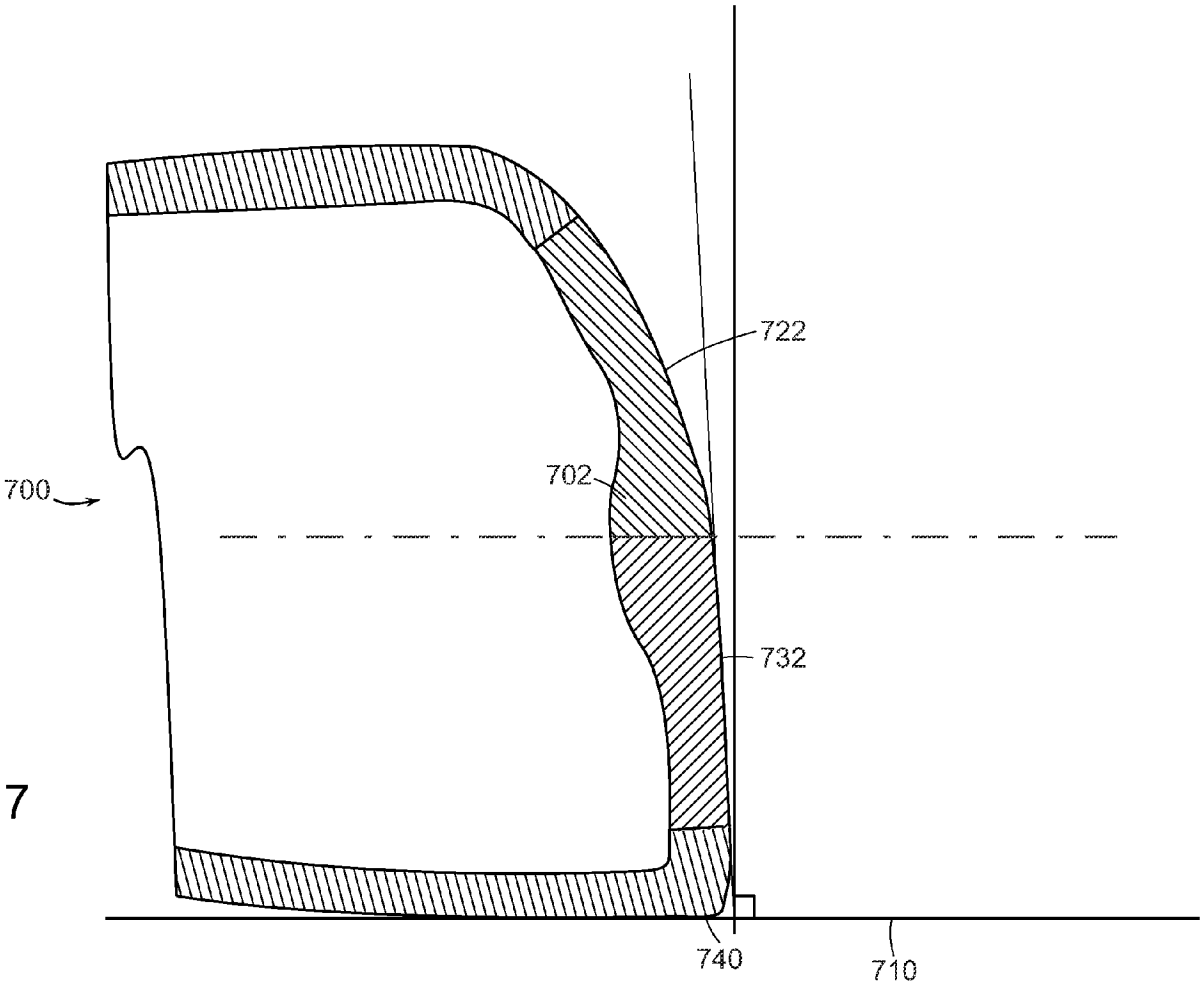
FIG. 7 shows an enlarged view of the face portion of an inventive metal wood type golf club head in accordance with an exemplary embodiment of the present invention.

FIG. 7 shows an enlarged cross sectional view of the face portion 702 of an inventive metal wood type golf club head 700 in accordance with an exemplary embodiment of the present invention to better illustrate the dual portioned face portion 702. Face portion 702 may be further comprised of a top portion 722 and a bottom portion 732 each having different roll characteristics. Roll characteristics may generally refer to the radius of curvature of the face portion 702 when measured vertically.

Top portion 722 of the face portion 702 may generally contain a roll having a first radius of curvature as shown in FIG. 7 resembling a roll profile of a typical driver type golf club head 100; allowing for reduction in backspin when a golf ball is hit above the center of the face. The roll in the top portion 722 may generally be helpful when the current inventive metal wood type golf club head 700 is used to hit a golf ball off a tee, as it would generally take a tee to hit a golf ball that high off the ground 710. In an exemplary embodiment of the present invention, the first radius of curvature of top portion 722 may generally be between about 11 degrees to about 13 degrees resembling the roll radius of curvature of a driver type golf club head 100.

Bottom portion 732, as shown in the current exemplary embodiment, may generally have a second radius of curvature resembling the face characteristics of a fairway type golf club head 300. In an exemplary embodiment of the present invention, the second radius of curvature of bottom portion 732 may generally be greater than about 15 degrees resembling, or even exceeding the roll radius of curvature of a fairway type golf club head 300. However, it should be noted that in an extreme situation, the radius of curvature of the bottom portion 732 may be so high that it creates a completely flat bottom portion 732 without departing from the scope and content of the present invention. The higher radius of curvature in the bottom portion 732 is generally preferred in a fairway type golf club head 300 because they make the club easier to hit off the ground 710 by eliminating some undesirable leading edge 740 curvature. The current inventive metal wood type golf club head 700 may retain this vertical roll bottom portion 732 to resemble the face of a fairway type golf club head 300 to allow the inventive metal wood type golf club head 700 to be capable of hitting directly off the ground 710 without the need for a tee.

In the current exemplary embodiment shown in FIG. 7, the first radius of curvature may generally be less than the second radius of curvature, as the top portion 722 may generally need more roll to control the spin of a shot hit off the tee. Inversely, the bottom portion 732 may generally need more radius of curvature and less roll to allow the inventive metal wood type golf club head 700 to actually pick a ball off the ground 710. In an exemplary embodiment of the present invention shown in FIG. 7, the ratio of the second radius of curvature over the first radius of curvature may generally be greater than 1.25, more preferably greater than 1.5, and more preferably greater than 2.0.

The enlarged view of the face portion 702 of the inventive metal wood golf club head 700 shown in FIG. 7 also shows a grounded leading edge 740 of the inventive metal wood type golf club head 700 almost touching the ground 710 allowing for better turf interaction. Turf interaction is important in the current inventive metal wood type golf club head 700 because the current inventive metal wood type golf club head 700 is intended to perform as well off the ground 710 as it would off a tee. In order for a metal wood type golf club head 700 to perform well off the ground, the leading edge 740 may generally be required to be almost touching the ground 710 in order to pick up a golf ball that is sitting on the ground 710. This is different from a driver type golf club head 100; wherein the leading edge is raised off the ground 110 in order eliminate unnecessary weight for a driver type golf club head 100 that is only intended to be hit off a tee. The grounded leading edge 740 may generally be accompanied by an increased curvature of the sole profile to improve the performance of the inventive metal wood type golf club head 700 without departing from the scope and content of the present invention.

Figure 8:
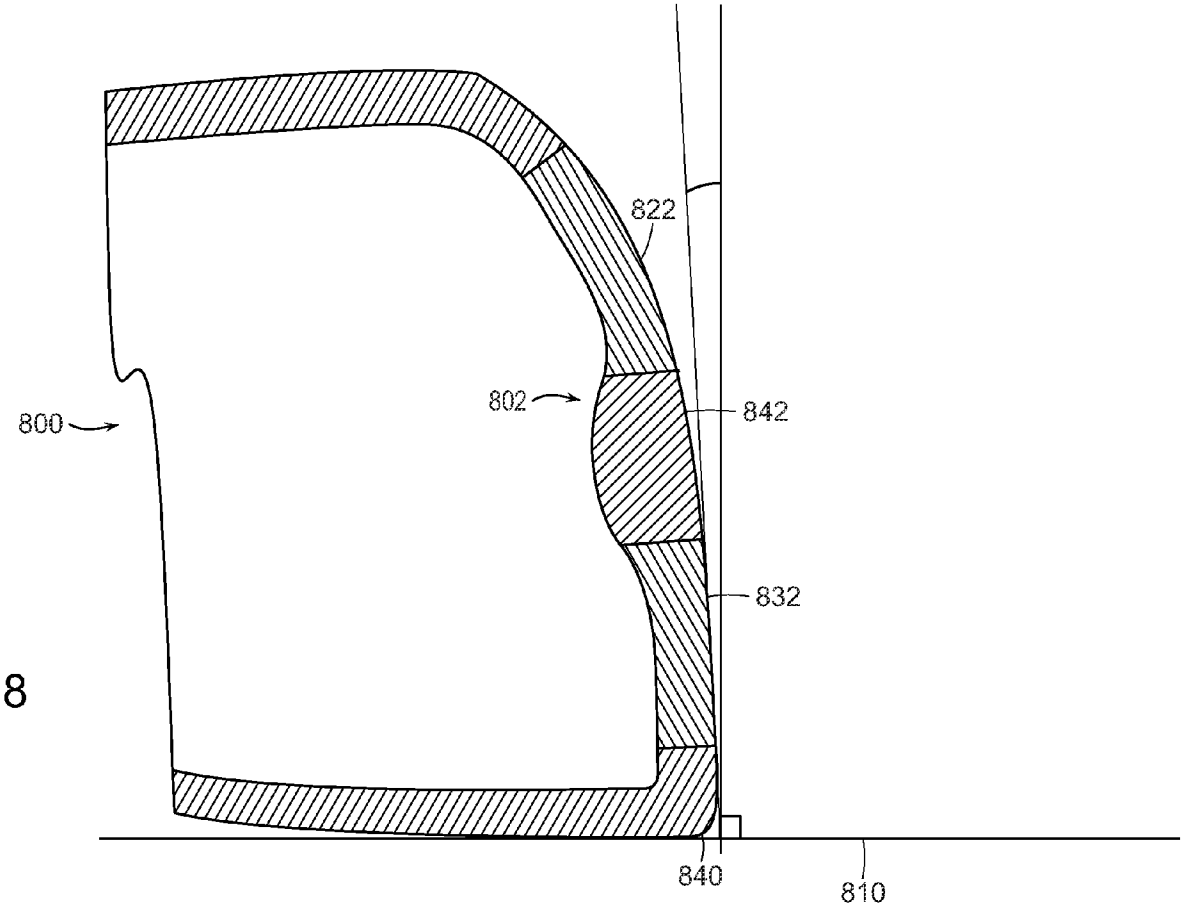
FIG. 8 shows an enlarged view of the face portion of an inventive metal wood type golf club in accordance with a further exemplary embodiment of the present invention.

FIG. 8 shows an even further alternative embodiment of the present invention wherein an enlarged view of the face portion 802 shows a triple portioned face portion 802 containing a top portion 822, a middle portion 842, and a bottom portion 832. In this current alternative embodiment, a central portion may be used to create a smoother transition between the top portion 822 and the bottom portion 832 with each portion having a different radius of curvature. Top portion 822, as shown in this alternative embodiment, may generally have a radius of curvature that is smaller than the radius of curvature of the bottom portion 832, with the middle portion 842 having a radius of curvature between the two portions. In an even further alternative embodiment of the present invention, middle portion 842 may be completely flat to help maintain the loft angle at a point of measurement to ensure consistency of the loft angle without departing from the scope and content of the present invention. Here, in this current exemplary embodiment, middle portion 842 may generally have the boundaries of separation defined by the geometric center of the face near the top and a point about 18 mm away from the ground 810 near the bottom. Although FIG. 7 and FIG. 8 show a dual portioned face portion 702 and a triple portioned 802 face portion respectively, the current invention may be applicable toward a quadruple portioned face portion, a five portioned face portion, or any number of divisions of face portions each having its own radius of curvature all without departing from the scope and content of the present invention.

Figure 9:
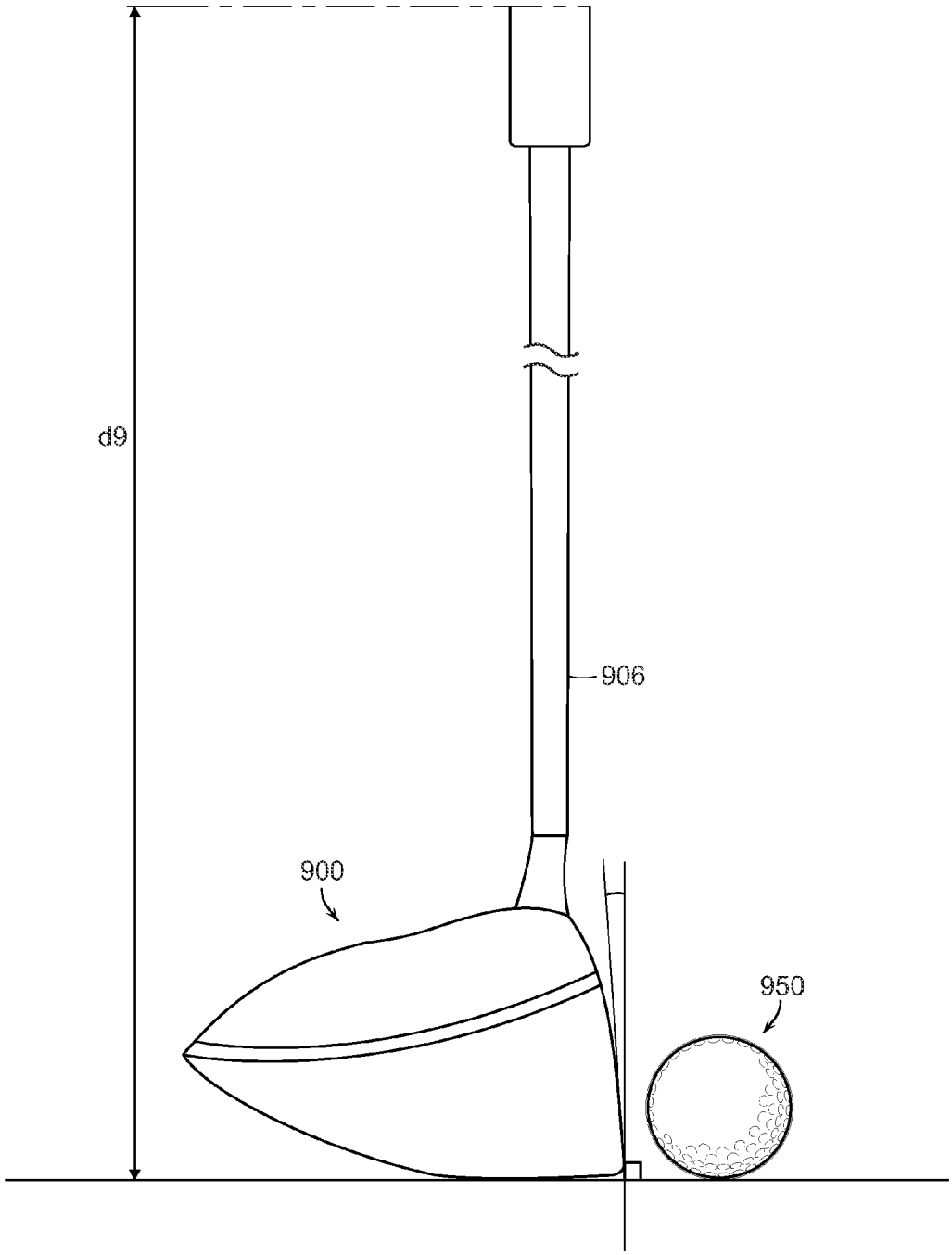
FIG. 9 shows a side profile view of an entire inventive metal wood type golf club showing the shaft as well as the overall length of the inventive metal wood type golf club head.

FIG. 9 shows a side view of an embodiment of the inventive metal wood type golf club head 900 connected to a shaft 906. Shaft 906 combined with the inventive metal wood type golf club head 900 may generally yield a club length d9 of between about 41 inches to about 45 inches to once again emphasize precision and control of the inventive metal wood type golf club head 900. The club length d9 of the inventive metal wood type golf club head 900 may generally be shorter than the club length of a driver type golf club head 100 in an effort to create a more controllable golf club that will increase accuracy and decrease general dispersion.

As it can be seen from above, the current inventive metal wood type golf club head 900 incorporates both the performance advantages of a driver type golf club head 100 as well as the performance advantages of a fairway type golf club head 300. More specifically, inventive metal wood type golf club head 900 may be capable of achieving the distances of a driver type golf club head 100 through its volume range, light weight material characteristics, as well the variable face thickness profile that are similar to a driver type golf club head 100. Additionally, the current inventive metal wood type golf club head 900 may be able to achieve the accuracy and playability of a fairway type golf club head 300 through the lower center of gravity, shorter shaft length, shallower face curvature, and inertia numbers that are similar to a fairway type golf club head 300. Hence, the current inventive metal wood type golf club head 900 is capable of combining the performance advantages of both a driver type golf club head 100 and a fairway type golf club head 300, which have been mutually exclusive in the past.

Figure 10:
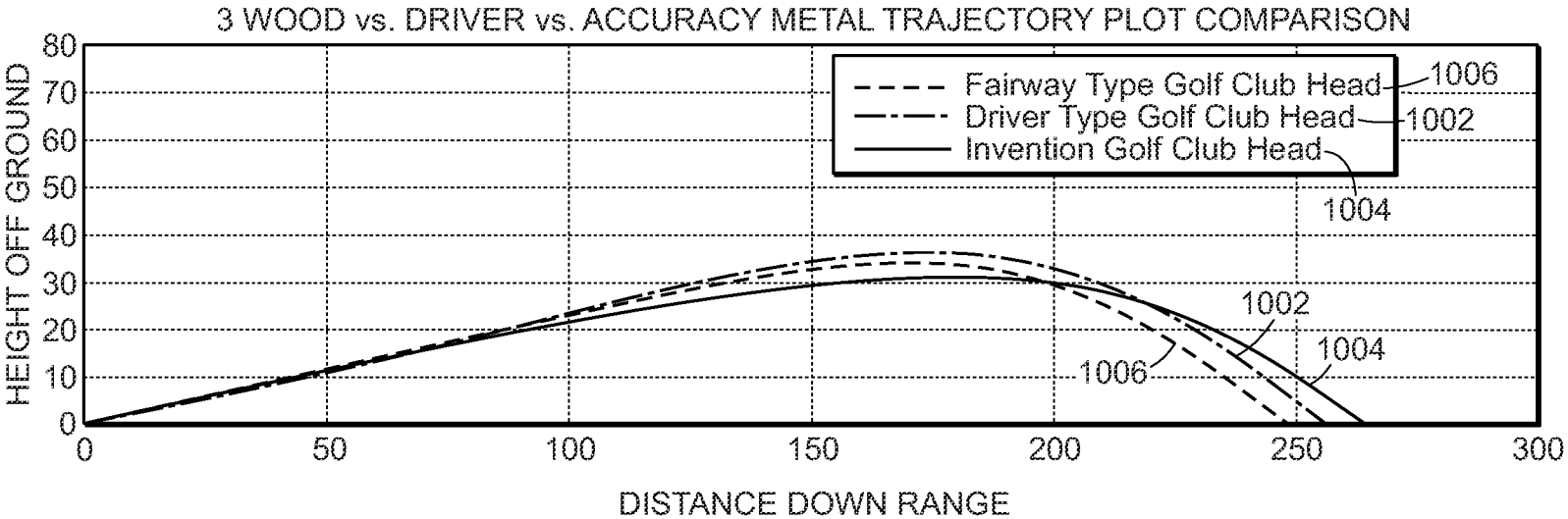
FIG. 10 shows a simulated trajectory plot of a golf ball being struck by a driver type golf club, a fairway type golf club, and an inventive metal wood type golf club.

FIG. 10 provides a good flight trajectory plot comparing the flight trajectory of a driver type golf club head 100, a fairway wood type golf club head 300, and an inventive metal wood type golf club head 900 in accordance with the present invention. Here, trajectory 1002 represents the general flight and trajectory pattern of a driver type golf club 100. Trajectory 1006 on the other hand represents the general flight and trajectory pattern of a fairway type golf club head 300. Trajectory 1004 represents the general flight and trajectory pattern in accordance with a golf ball struck with the current inventive metal wood type golf club head 900. Notice how trajectory 1004, representing the flight and trajectory pattern of the current inventive metal wood type golf club head 900, may generally have a flight trajectory pattern that is between trajectory 1002 and trajectory 1006. This flight pattern may generally represent the increased distance capabilities of the current inventive metal wood type golf club head 900 in accordance with the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the following portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A metal wood type golf club comprising:
a shaft;
a grip connected to a proximal end of said shaft; and
a golf club head connected to a distal end of said shaft; wherein said club head further comprises;
a face portion providing a striking surface; and
a body portion extending from a rear section of said face portion including a crown portion and a sole portion,
wherein a total length of said shaft combined with said golf club head is between 41 inches to 45 inches;
wherein a maximum COR value of said head club head is between about 0.790 to about 0.830;
wherein said golf club head has a volume of between 200 cc to 300 cc;
wherein said golf club head has a loft angle β of between about 10 degrees and about 16 degrees;
wherein said golf club head has a geometric center of the face about 18 mm away from a ground, and
wherein said face depth height is between about 30 mm to about 65 mm.

2. The metal wood type golf club of claim 1, wherein an MOI value about said y-axis is between about 2,500 g-cm$^2$ to about 4,500 g-cm$^2$.

3. The metal wood type golf club of claim 1, wherein said golf club head has a CG to face depth height ratio, defined by a height of a CG location of said golf club head divided by a face depth, of less than about 0.40.

4. The metal wood type golf club of claim 3, wherein said CG location is located about 10 mm to about 20 mm above a ground plane.

5. The metal wood type golf club of claim 1, wherein said face portion is made out of titanium.

6. The metal wood type golf club of claim 1, wherein said golf club head has a performance factor of greater than about 2,900 g-cm$^2$; said performance factor defined as the product of said face depth height, a maximum COR value of said golf club head, and a MOI value of said golf club head about a y-axis, all divided by a height of said CG location.

7. The metal wood type golf club of claim 1, wherein said face portion further comprises;
a top portion containing a first radius of curvature; and
a bottom portion containing a second radius of curvature;
wherein said second radius of curvature is greater than said first radius of curvature.

8. The metal wood type golf club head of claim 7, wherein said second radius of curvature is greater than 1.25 times of said first radius of curvature.

9. A metal wood type golf club comprising:
a shaft;
a grip connected to a proximal end of said shaft; and
a golf club head connected to a distal end of said shaft; wherein said club head further comprises;
a face portion providing a striking surface, defining a face depth height, for striking a golf ball; and
a body portion extending from a rear section of said face portion including a crown portion and a sole portion,
wherein a total length of said shaft combined with said golf club head is between 41 inches to 45 inches;
wherein said golf club head has a performance factor of greater than about 2,900 g-cm$^2$; said performance factor defined as the product of said face depth height, a maximum COR value of said golf club head, and a MOI value of said golf club head about a y-axis, all divided by a height of said CG location;
wherein said golf club head has a volume of between 200 cc to 300 cc; and
wherein said golf club head has a loft angle β of between about 10 degrees and about 16 degrees,
wherein said golf club head has a geometric center of the face about 18 mm away from a ground, and
wherein said face depth height is between about 30 mm to about 65 mm.

10. The metal wood type golf club of claim 9, wherein said face portion further comprises;
a top portion containing a first radius of curvature; and
a bottom portion containing a second radius of curvature;
wherein said second radius of curvature is greater than said first radius of curvature.

11. The metal wood type golf club of claim 10, wherein said second radius of curvature is greater than 1.25 times of said first radius of curvature.

12. The metal wood type golf club of claim 9, wherein said golf club head has a CG to face depth ratio, defined by a height of a CG location of said golf club head divided by said face depth height, of less than about 0.40.

13. The metal wood type golf club of claim 12, wherein an MOI value about said y-axis is between about 2,500 g-cm$^2$ to about 4,500 g-cm$^2$.

* * * * *